US011339784B2

(12) United States Patent
Rosinski

(10) Patent No.: US 11,339,784 B2
(45) Date of Patent: May 24, 2022

(54) CARTRIDGE-STYLE FLUID PUMP ASSEMBLY WITH INTEGRATED PUMP COVER MOUNT

(71) Applicant: GHSP, Inc., Grand Haven, MI (US)

(72) Inventor: Ryan David Rosinski, Whitehall, MI (US)

(73) Assignee: GHSP Inc., Holland, MI (US)

( * ) Notice: Subject to any disclaimer, the term of this patent is extended or adjusted under 35 U.S.C. 154(b) by 135 days.

(21) Appl. No.: 16/835,773

(22) Filed: Mar. 31, 2020

(65) Prior Publication Data

US 2020/0325896 A1 Oct. 15, 2020

Related U.S. Application Data

(60) Provisional application No. 62/834,043, filed on Apr. 15, 2019.

(51) Int. Cl.

| | |
|---|---|
| ***F04C 2/14*** | (2006.01) |
| ***F04C 15/00*** | (2006.01) |
| ***F04C 11/00*** | (2006.01) |
| ***F04C 2/10*** | (2006.01) |

(52) U.S. Cl.
CPC ..... *F04C 15/0042* (2013.01); *F04C 2/10* (2013.01); *F04C 2240/30* (2013.01); *F04C 2270/175* (2013.01)

(58) Field of Classification Search
CPC ..... F04C 15/0042; F04C 11/008; F04C 15/0015; F04C 15/0023; F04C 2240/30
See application file for complete search history.

(56) References Cited

U.S. PATENT DOCUMENTS

| | | | | |
|---|---|---|---|---|
| 2,477,797 | A * | 8/1949 | Girz | F04C 15/0023 418/135 |
| 4,662,827 | A * | 5/1987 | Wiernicki | F02M 37/08 417/363 |
| 4,940,394 | A * | 7/1990 | Gibbons | F04C 13/002 417/283 |
| 2017/0254329 | A1* | 9/2017 | Andreis | F04C 15/0023 |

FOREIGN PATENT DOCUMENTS

| | | |
|---|---|---|
| EP | 3029333 | 4/2018 |
| RU | 47994 | 9/2005 |
| WO | 2016014715 | 1/2016 |

* cited by examiner

*Primary Examiner* — Deming Wan
(74) *Attorney, Agent, or Firm* — Price Heneveld LLP

(57) ABSTRACT

A fluid pump includes a stator. A rotor is rotationally operable with respect to the stator. A drive shaft extends from the rotor to a pump assembly that delivers a fluid from an inlet to an outlet. A pump housing includes an interior cavity that contains the stator, the rotor and the pump assembly. A pump cover is disposed at an end of the pump housing. The pump cover defines an end of the interior cavity. A spring assembly biases the pump cover in an axial direction toward the pump assembly.

16 Claims, 8 Drawing Sheets

CARTRIDGE-STYLE FLUID PUMP ASSEMBLY WITH INTEGRATED PUMP COVER MOUNT

CROSS-REFERENCE TO RELATED APPLICATION

This application claims priority to and the benefit under 35 U.S.C. § 119(e) of U.S. Provisional Patent Application No. 62/834,043, filed on Apr. 15, 2019, entitled CARTRIDGE-STYLE FLUID PUMP ASSEMBLY WITH INTEGRATED PUMP COVER MOUNT, the entire disclosure of which is hereby incorporated herein by reference.

FIELD OF THE INVENTION

The present invention generally relates to fluid pumps, and more specifically, a cartridge-style fluid pump that includes a fastener-free pump assembly installed within a pump housing.

BACKGROUND OF THE INVENTION

In conventional fluid pumps, internal components of the fluid pump are attached through various fasteners that attach typically stationary components to a housing of the pump. These stationary components can include various pump assemblies that are attached to an outer housing as well as various controllers and covers that are fixedly attached to the remainder of the housing. In a cartridge-style pump, the pump is inserted within an engine, transmission, or other fluid-handling mechanism for moving fluid from one location to another. The cartridge-style pump is typically in the form of a self-contained assembly that can be attached to an electrical system for the device and within some form of fluid or gaseous reservoir such that the pump can operate to move the material through the cartridge-style pump.

SUMMARY OF THE INVENTION

According to one aspect of the present invention, a fluid pump includes a stator. A rotor is rotationally operable with respect to the stator. A drive shaft extends from the rotor to a pump assembly that delivers a fluid from an inlet to an outlet. A pump housing includes an interior cavity that contains the stator, the rotor and the pump assembly. A pump cover is disposed at an end of the pump housing. The pump cover defines an end of the interior cavity. A spring assembly biases the pump cover in an axial direction toward the pump assembly.

According to another aspect of the present invention, a fluid pump includes a pump housing having an interior cavity. A pump element is positioned within the interior cavity and delivers a fluid from an inlet to an outlet. A pump cover defines an end of the interior cavity. A spring assembly axially biases the pump cover toward the pump element. The spring assembly, the pump cover and the pump element are retained within a perimeter retaining channel of the pump housing without the use of fasteners.

According to another aspect of the present invention, a fluid pump includes a pump housing having an interior cavity. A generated rotor is positioned within the interior cavity and delivers a fluid from an inlet to an outlet. A pump cover defines an end of the interior cavity. A pre-load ring-shaped spring axially biases the pump cover toward the generated rotor. A retaining ring is rotationally and axially fixed relative to the pump housing. The retaining ring, the pre-load ring-shaped spring and the pump cover are positioned within a perimeter retaining channel of the pump housing without the use of fasteners.

These and other aspects, objects, and features of the present invention will be understood and appreciated by those skilled in the art upon studying the following specification, claims, and appended drawings.

DETAILED DESCRIPTION OF THE PREFERRED EMBODIMENTS

Figure 1:
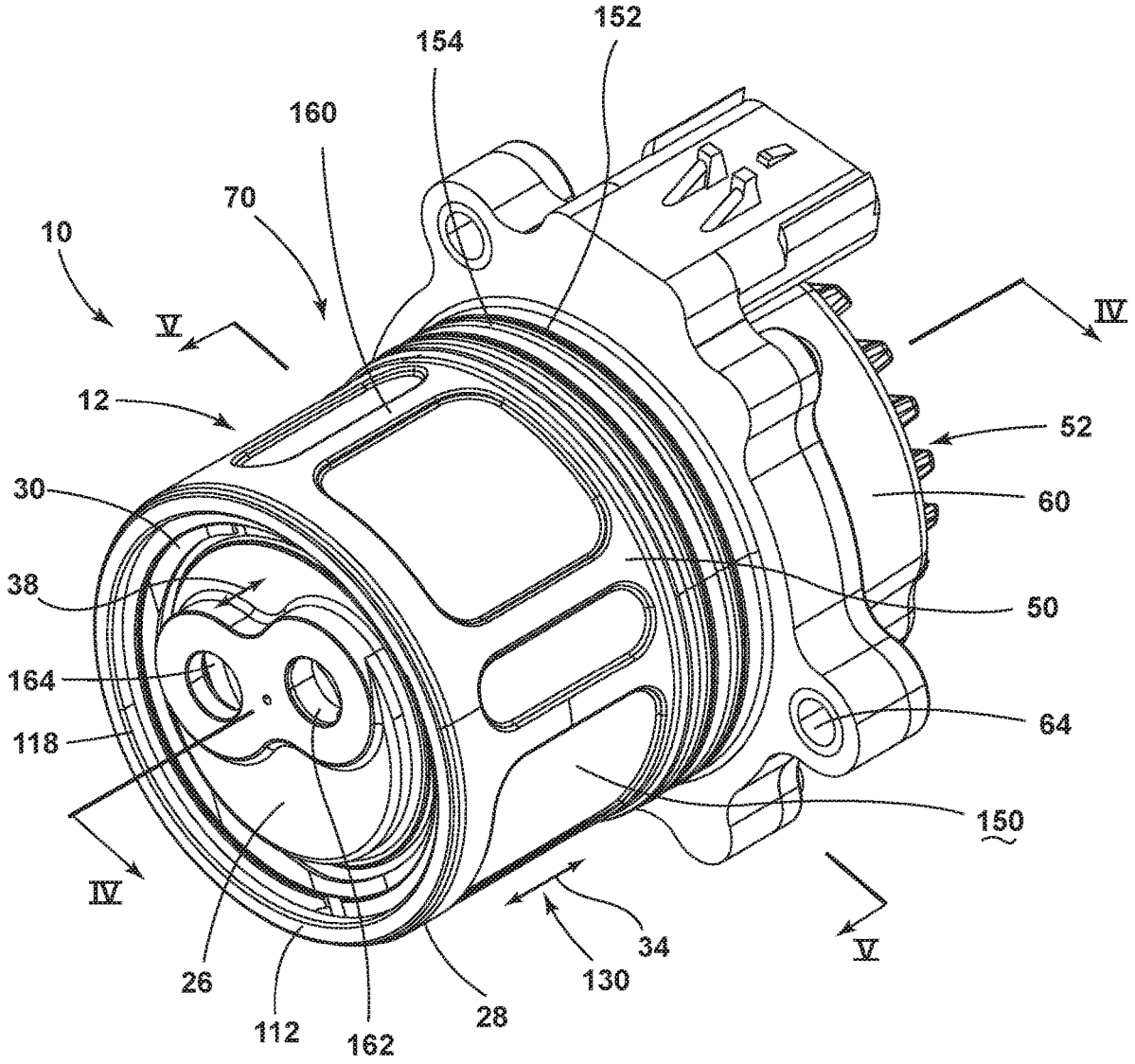
FIG. 1 is a side perspective view of an aspect of the fastenerless fluid pump.
Figure 2:
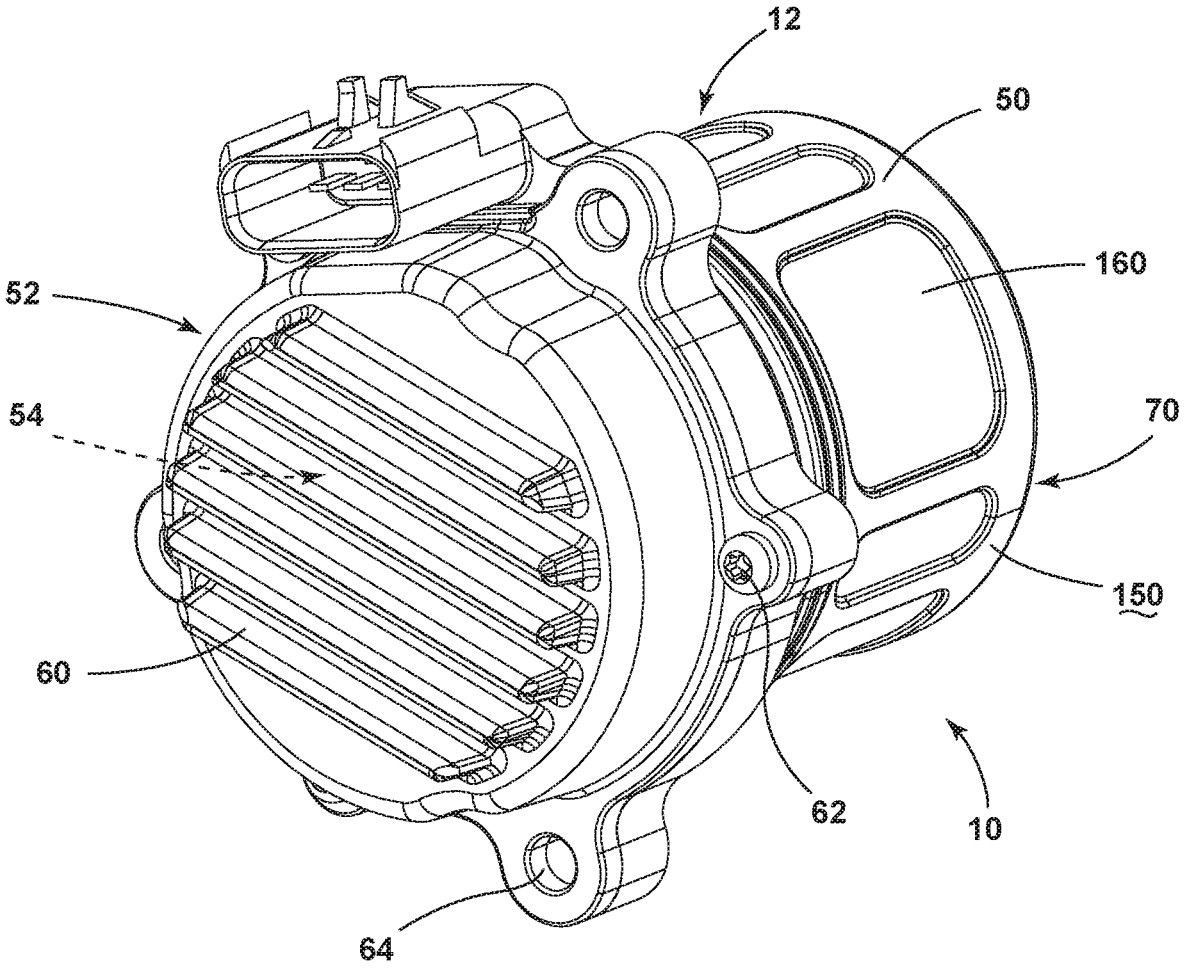
FIG. 2 is another side perspective view of the fastenerless fluid pump of FIG. 1.
Figure 3:
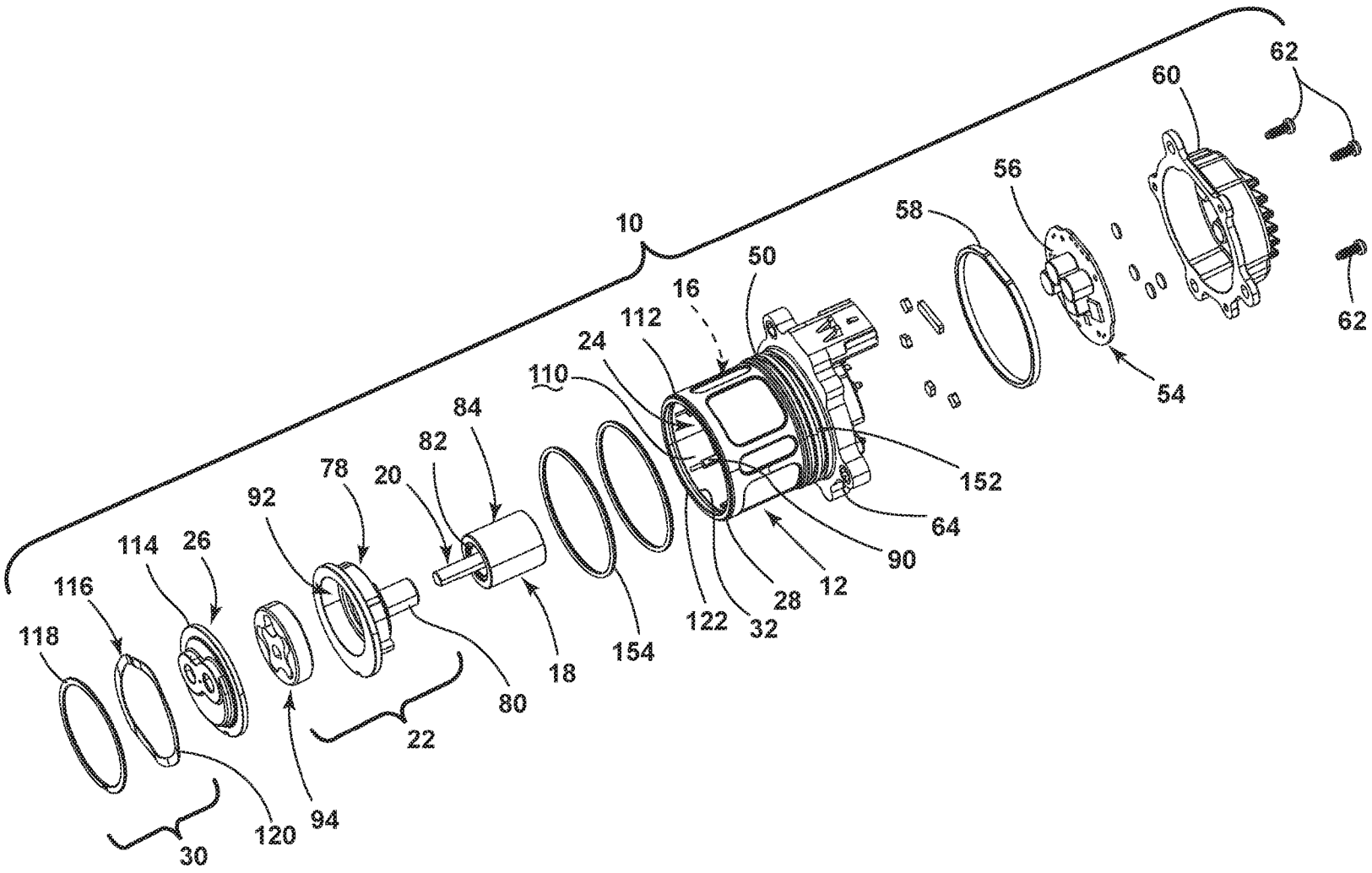
FIG. 3 is an exploded perspective view of the fastenerless fluid pump of FIG. 1.
Figure 4:
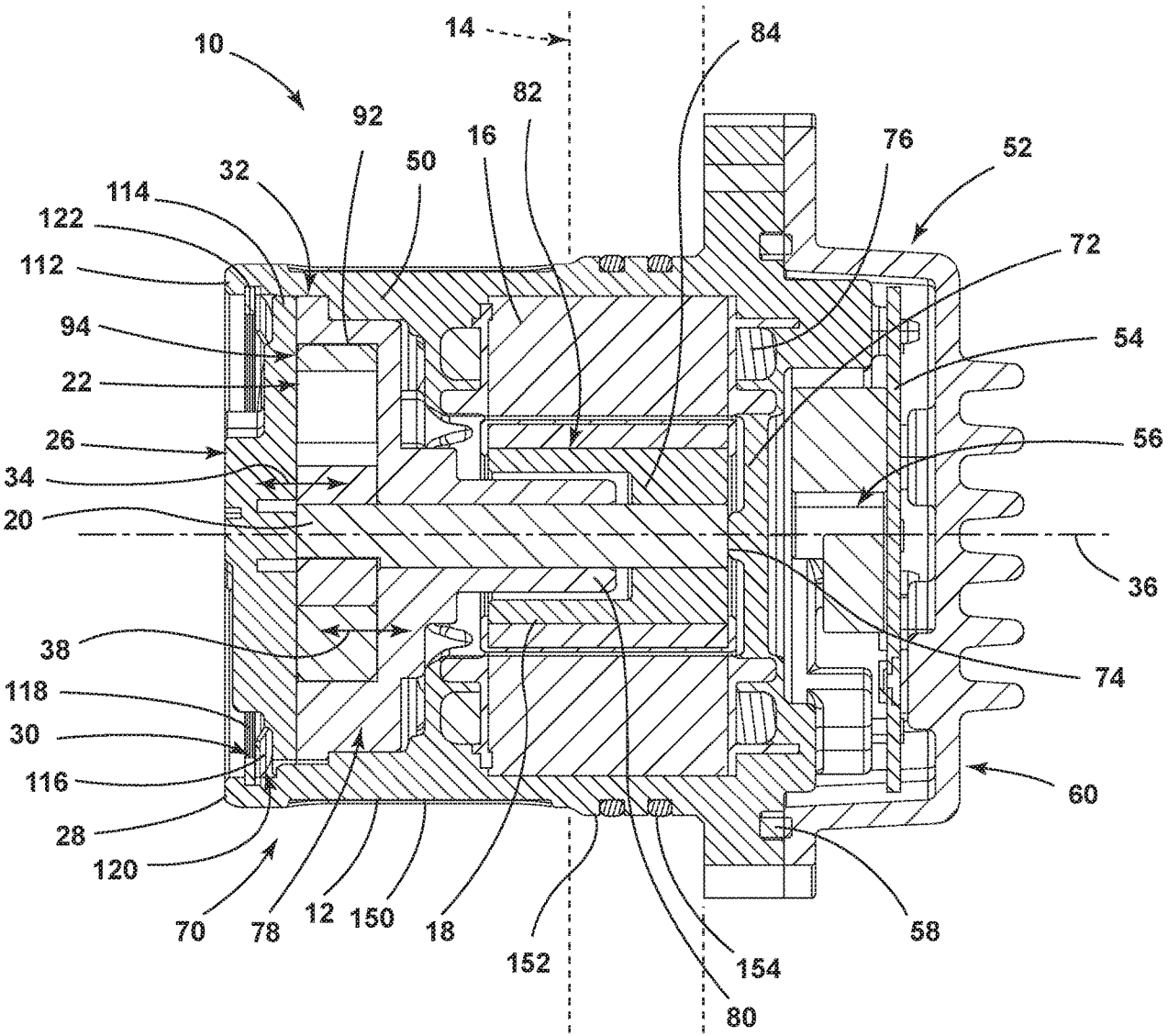
FIG. 4 is a cross-sectional view of the fastenerless fluid pump of FIG. 1, taken along line IV-IV.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

As exemplified in FIGS. 1-11, reference numeral 10 generally refers to a fluid pump that includes a fastenerless assembly mechanism, whereby various components of the fluid pump 10 can be secured within a pump housing 12 without the use of external fasteners such as screws, bolts, and other similar fastening mechanisms. The fluid pump 10 can typically be in the form of a cartridge-style fluid pump 10 that is slidably installed within a fluid-handling assembly 14, where the fluid pump 10 can be activated to move fluid, gas, or other fluid-type material from a reservoir to a separate location. According to various aspects of the device, the fluid pump 10 includes a stator 16 and a rotor 18 that is rotationally operable with respect to the stator 16. A drive shaft 20 extends from the rotor 18 to a pump assembly 22. A pump housing 12 includes an interior cavity 24 that contains the stator 16, the rotor 18 and the pump assembly 22. A pump cover 26 is disposed at an end 28 of the pump housing 12, where the pump cover 26 defines an end 28 of the interior cavity 24 for the pump housing 12. A spring assembly 30 is positioned and retained within a retaining channel 32 of the pump housing 12. The spring assembly 30 serves to bias the pump cover 26 in a generally axial direction 34 toward the pump assembly 22 and along a rotational axis 36 of the drive shaft 20. The pump cover 26 is slidably operable within the perimeter retaining channel 32 to absorb thermal expansion forces 38 as well as manufacturing tolerances that may be present within a series of manufactured pump housings 12. The expansion forces 38 can result from thermal expansion as well as changes in the viscosity of the fluid being moved via the fluid pump 10.

As exemplified in FIGS. 1-5, the fluid pump 10 can include a stator 16 that is overmolded by an overmold material 50 to form the pump housing 12. The pump housing 12 can include a control side 52 that receives a printed circuit board (PCB) 54, where the PCB 54 can include various controllers 56 for operating the fluid pump 10. A PCB gasket 58 can be installed adjacent to the PCB 54 to provide a seal around the various electrical and processing components of the PCB 54. A PCB cover 60 can also extend over the PCB 54 to engage the PCB gasket 58. Various housing fasteners 62 can be disposed within the PCB cover 60 for fastening the PCB cover 60 to the pump housing 12. The PCB cover 60 and the pump housing 12 can also cooperatively define various attachment apertures 64 that can be used to fasten the fluid pump 10 to the fluid-handling assembly 14 within which the fluid pump 10 operates.

Referring again to FIGS. 1-5, the pump housing 12 can also include a motor end 70, where the stator 16 of the fluid pump 10 is overmolded within a portion of the pump housing 12. The pump housing 12 can define an interior cavity 24 that defines a space for receiving the rotor 18 and the pump assembly 22. For receiving the rotor 18, the pump housing 12 can include a bearing plate 72 that includes a bearing assembly 74 against which the drive shaft 20 and the rotor 18 are held in place for rotational operation within the interior cavity 24 of the pump housing 12. The rotor 18, being in electromagnetic communication with the stator 16, rotates within the interior cavity 24 when portions of the stator 16 are energized through the application of electrical current through the windings 76 of the stator 16. The pump body 78 can include a pump sleeve 80 that extends around a portion of the drive shaft 20 and into a rotor channel 82 that is at least partially defined between the body 84 of the rotor 18 and the drive shaft 20. The use of the pump sleeve 80 provides a locating feature and a support feature that extends around the drive shaft 20. The pump sleeve 80 at least partially covers the drive shaft 20 and helps to support the drive shaft 20 within the interior cavity 24 of the pump housing 12.

In order to maintain the position of the pump body 78 within the pump housing 12, the pump housing 12 can include one or more alignment features 90 that are integrally formed within the material of the pump housing 12. The pump body 78 typically includes an offset configuration and includes a pump receptacle 92 that receives a gerotor assembly 94, such as a generated rotor. The pump receptacle 92 is typically positioned in an offset configuration within the pump body 78. Because of this offset configuration, a specific rotational alignment of the pump body 78 within the pump housing 12 is desired. The use of the alignment feature 90 defined within the pump housing 12 provides this locating feature so that additional fasteners are not needed to locate the pump body 78 with respect to the pump housing 12. The alignment features 90 defined within the pump housing 12 serve to rotationally align the pump body 78 with respect to the pump housing 12 and the drive shaft 20 of the rotor 18.

The locating or alignment features 90 defined within the pump housing 12 also serve to align the pump cover 26 with respect to the pump housing 12. Accordingly, the alignment features 90 of the pump housing 12 serve to rotationally align, or rotationally fix, the pump body 78, the gerotor assembly 94 and the pump cover 26 within the pump housing 12. This aligning configuration of the various components of the fluid pump 10 allows for easy and consistent manufacturing processes that can be used to produce a repeated and consistent manufactured product that can be assembled without the use of external fasteners, such as bolts, screws, and other similar external fasteners. Stated another way, the pump cover 26, the pump body 78 and the gerotor assembly 94 are self-aligning within the pump housing 12 and can only be installed in a very limited number of rotational configurations. Typically, the pump body 78 and the pump cover 26 can only be installed in a single rotational position with respect to the pump housing 12. This single rotational position is promoted by the alignment feature 90 of the pump housing 12. The use of the alignment feature 90 also allows for axial movement of at least the pump cover 26, as will be described more fully below.

The gerotor assembly 94 includes an internal gear 100 that is centered within the pump housing 12 and which attaches to the drive shaft 20. During rotation of the rotor 18, the internal gear 100 of the gerotor assembly 94 rotates within the eccentric outer component 102 of the gerotor assembly 94 to operate the pump assembly 22 of the fluid pump 10.

In order to retain the pump body 78, gerotor assembly 94 and pump cover 26 within the pump housing 12, the spring assembly 30 for the fluid pump 10 is installed within the retaining channel 32 of the pump housing 12. This retaining channel 32 is defined within an inner surface 110 of the pump housing 12 and near an outer rim 112 of the motor end 70 of the pump housing 12. An outer edge 114 of the pump cover 26 is installed within the retaining channel 32 along with a biasing member 116 and a retaining ring 118. The retaining ring 118 helps to secure the pump cover 26, the pump body 78 and the biasing member 116 within the retaining channel 32. In this manner, the retaining ring 118 is secured within a locking recess 122 of the retaining channel 32. The biasing member 116 is typically in the form of a pre-load spring 120. This pre-load spring 120 can be in the form of a ring-shaped member with a plurality or series of resilient undulations that serve to provide a biasing member 116 that biases the pump cover 26 away from the retaining ring 118, which is maintained within the locking recess 122. The biasing member 116 serves to separate the pump cover 26 and the retaining ring 118. These features are contained within the retaining channel 32 of the pump housing 12. The spring assembly 30 also biases the rotor 18 toward the bearing assembly 74 without using external fasteners.

The use of the pre-load spring 120 that is defined between the retaining ring 118 and the pump cover 26 provides for a minimal amount of sliding movement 130 of the pump cover 26 in the axial direction 34 within the retaining channel 32. Additionally, the configuration of the alignment feature 90 provides for rotational alignment of the pump cover 26, while also providing for the sliding movement 130 in the axial direction 34 that is parallel with the rotational axis 36 of the rotor 18. This minimal amount of sliding movement 130 allows for a certain amount of thermal expansion of the various components of the fluid pump 10 during operation of the fluid pump 10. In certain aspects of the device, the retaining ring 118 may also be afforded some limited movement within the locking recess 122.

By way of example, and not limitation, the fluid pump 10 can be used to move fluids that may experience a wide range of temperature fluctuations. As the fluid experiences these temperature fluctuations, the temperature fluctuations can change the viscosity of the fluid and, in certain aspects of the device, can also cause the various components of the fluid pump 10 to experience similar temperature fluctuations. These temperature fluctuations may result in expansion and/or contraction of various components of the fluid pump 10. This thermal expansion and contraction of the fluid and components of the fluid pump 10 can be absorbed by the pre-load spring 120 of the fluid pump 10. Because the fluid pump 10 does not include any external fasteners within the pump body 78, the pump assembly 22 and the pump cover 26, the thermal expansion and contraction of the fluid and the various materials of the fluid pump 10 are allowed to take place. These movements are allowed to be absorbed by the pre-load spring 120. Accordingly, internal stresses are minimized by providing for a mechanism that absorbs various viscosity fluctuations of the fluid and internal dimensional fluctuations of the various materials of the fluid pump 10.

Additionally, while manufacturing processes are relatively consistent, manufacturing tolerances may be experienced between various manufactured components. Accordingly, use of the pre-load spring 120 that is disposed between the retaining ring 118 and the pump cover 26 allows for a mechanism that absorbs various tolerances that may be experienced between manufactured components of different fluid pumps 10. Accordingly, these manufacturing tolerances can be accounted for and a certain amount of variation within the manufactured components may be acceptable during manufacture of the various components of the fluid pump 10. By increasing the dimensional tolerances that may be acceptable within the fluid pump 10, manufacturing costs can be decreased and the amount of waste experienced during the manufacturing process can also be decreased.

Figure 5:
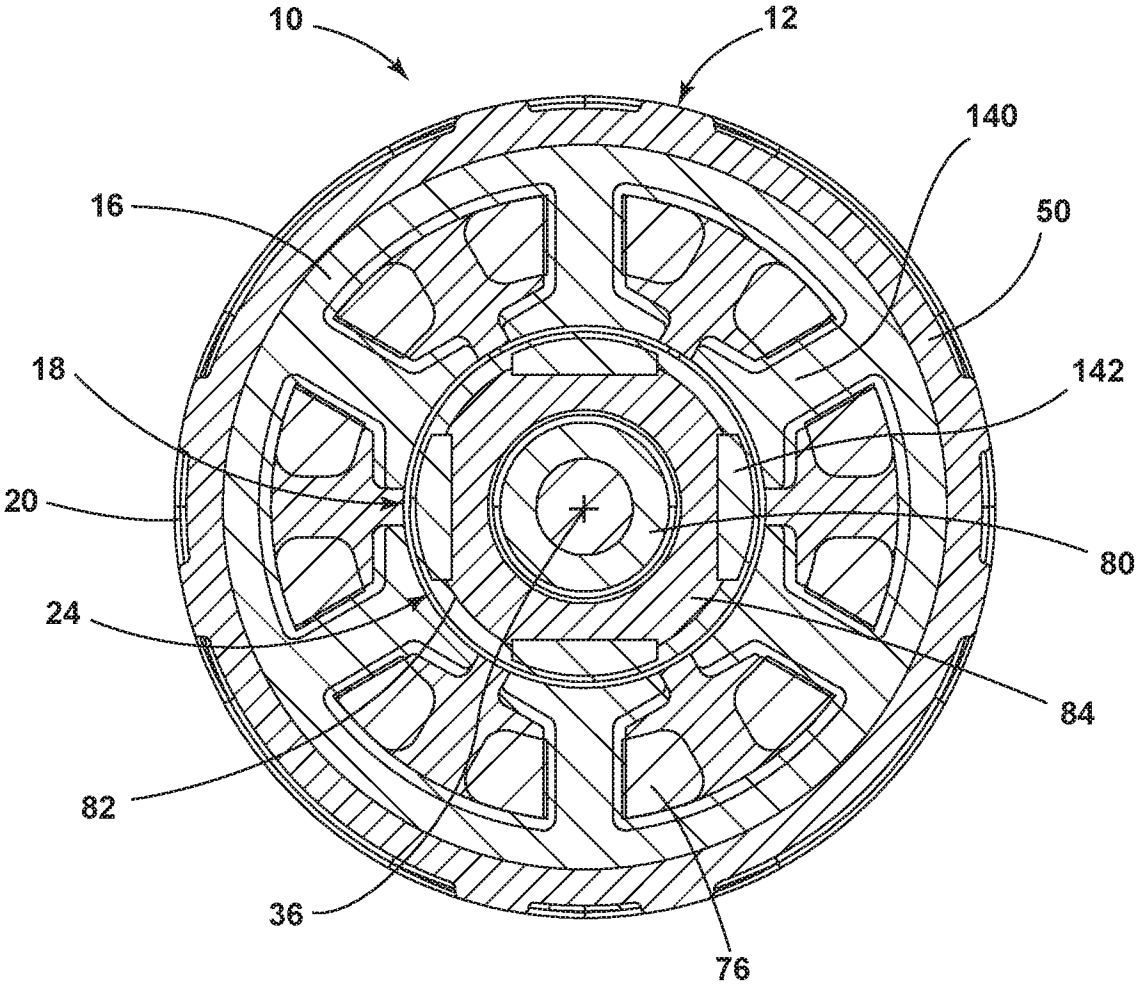
FIG. 5 is a lateral cross-sectional view of the fastenerless fluid pump of FIG. 1, taken along line V-V.
Figure 6:
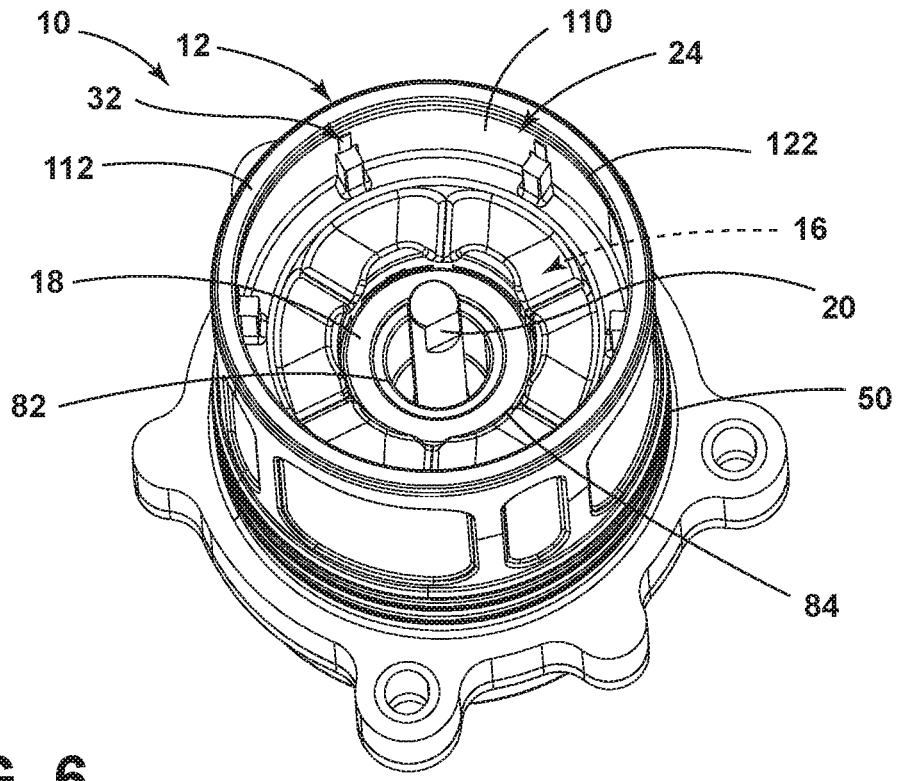
FIG. 6 is a side perspective view of the fastenerless fluid pump showing the stator and rotor installed within the pump housing.
Figure 7:
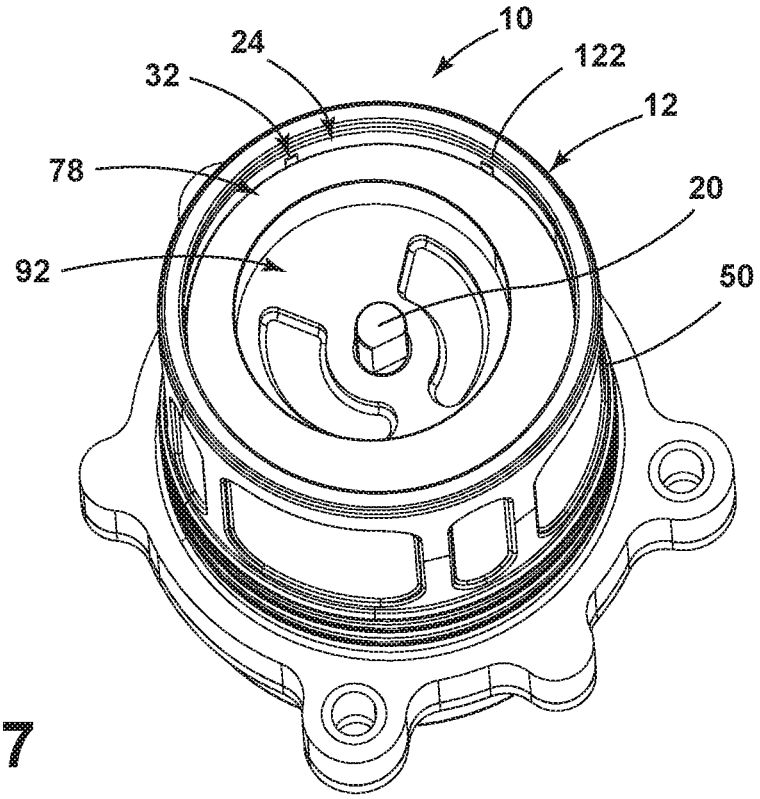
FIG. 7 is a side perspective view of the fastenerless fluid pump of FIG. 6 with the pump body installed in the pump housing.
Figure 8:
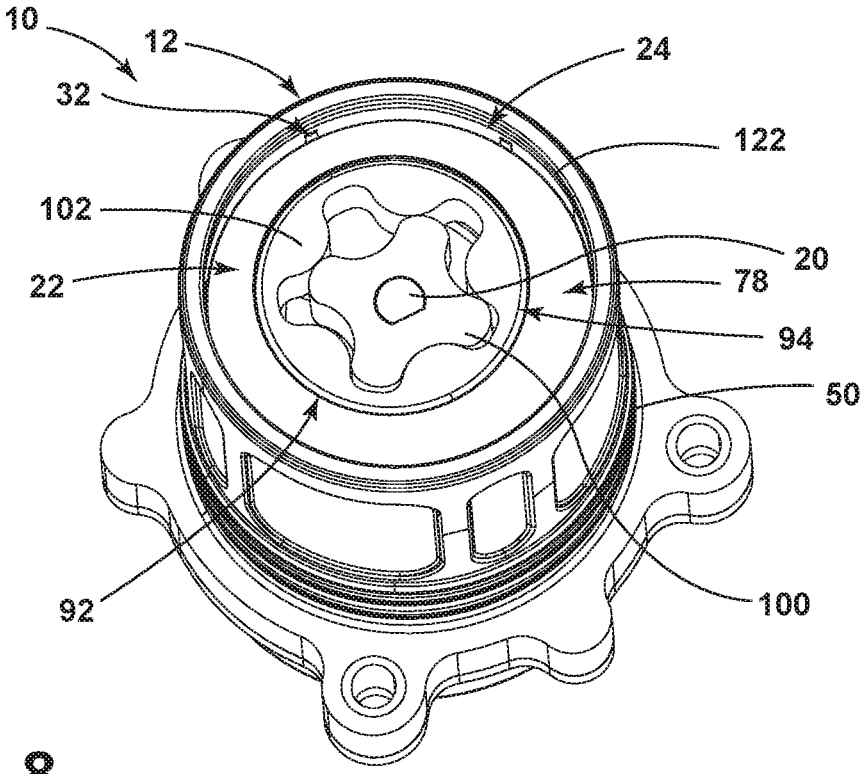
FIG. 8 is a side perspective view of the fastenerless fluid pump of FIG. 7 with the gerotor assembly installed within the pump body.
Figure 9:
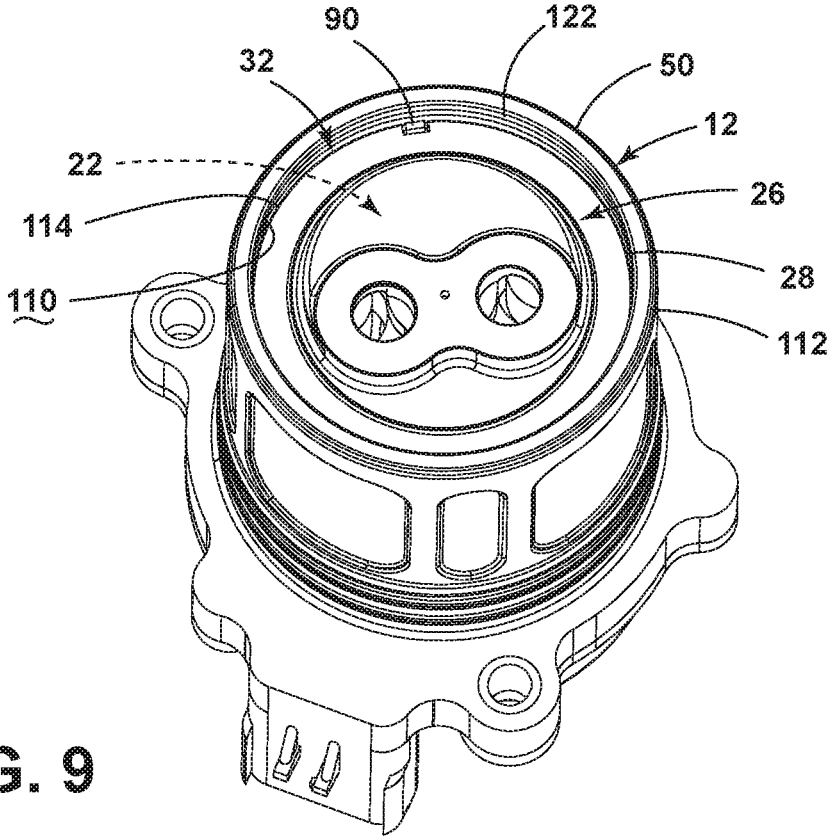
FIG. 9 is a side perspective view of the fastenerless fluid pump of FIG. 8 with the pump cover installed within the locking recess of the pump housing.

As exemplified in FIG. 5, the fluid pump 10 can include a rotor 18 that operates with respect to a stator 16. The stator 16 can include a number of stator poles 140 that receive windings 76 that are wrapped around the various poles 140. As the windings 76 receive electrical current, these windings 76 are energized and provide an electro-magnetic communication between the windings 76 of the stator 16 and the various magnets 142 that are positioned within the body 84 of the rotor 18. As the windings 76 are energized, the electromagnetic communication produces an electromagnetic force that rotates the rotor 18 within the stator 16. As discussed above, the stator 16, windings 76 and the stator poles 140 can be overmolded by the overmold material 50 that forms the pump housing 12.

As exemplified in FIGS. 6-11, assembly of the fluid pump 10 can include various repeatable steps that may be accomplished without the need for external fasteners securing the various components to the pump housing 12. As exemplified in FIG. 6, the rotor 18 can be disposed within the stator 16 that is overmolded within the material that forms the pump housing 12. When the rotor 18 is located, the pump body 78 can be installed within the pump housing 12 (shown in FIG. 7) and the pump sleeve 80 can be inserted into the rotor channel 82 to at least partially surround the drive shaft 20 of the rotor 18. After the pump body 78 is installed, the gerotor assembly 94 can be installed within the pump receptacle 92 of the pump body 78 (shown in FIG. 8).

As discussed previously, the pump receptacle 92 of the pump body 78 can typically be positioned in an off-center or eccentric position with respect to the rotor 18 and the drive shaft 20. The central internal gear 100 of the gerotor assembly 94 is typically centrally aligned within the pump housing 12 to be rotated by the drive shaft 20. After the gerotor assembly 94 is installed, the pump cover 26 is installed on top of the gerotor assembly 94 (shown in FIG. 9). As discussed above, the pump housing 12 includes various alignment features 90 that serve to provide a single rotational orientation of the pump body 78 and the pump cover 26 within the pump housing 12. As discussed above, these locating features serve to rotationally align the components of the fluid pump 10 within the pump housing 12 so that additional fasteners are not needed for rotationally locating the pump body 78 and the pump cover 26.

Figure 10:
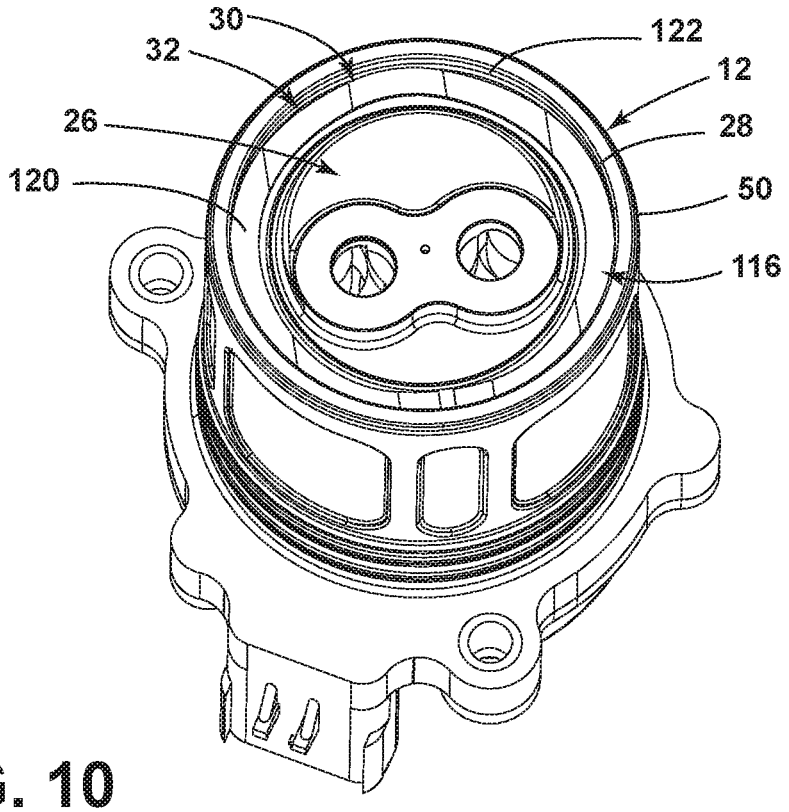
FIG. 10 is a side perspective view of the fastenerless fluid pump of FIG. 9 with the pre-load spring installed within the locking recess of the pump housing.
Figure 11:
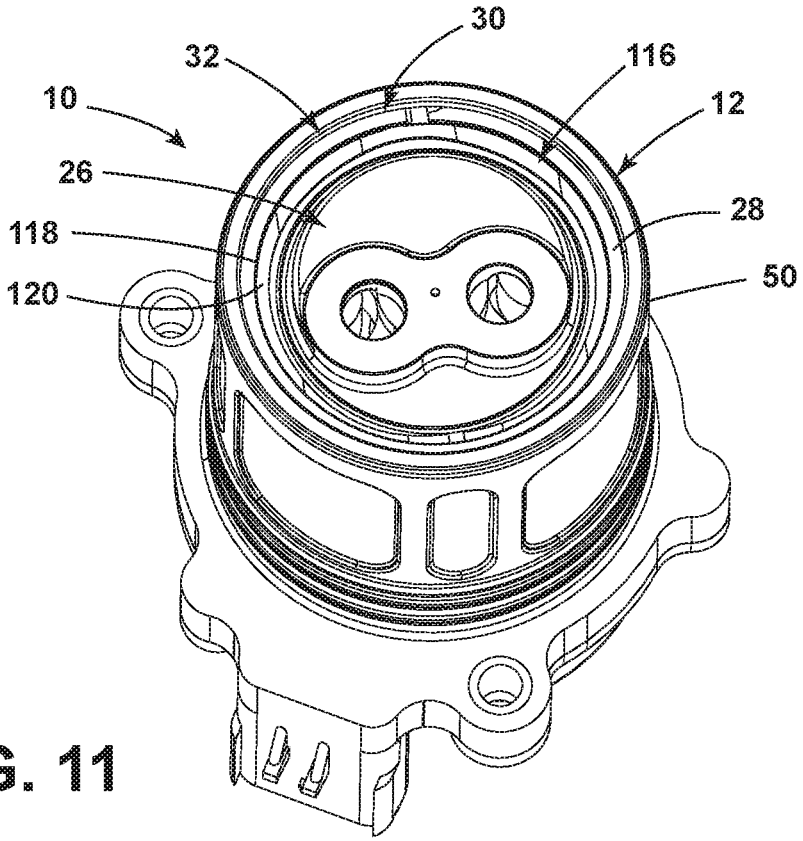
FIG. 11 is a side perspective view of the fastenerless fluid pump of FIG. 10 with the retaining ring installed within the locking recess of the pump housing.

After the pump cover 26 is installed, the pre-load spring 120 and retaining ring 118 are positioned within the retaining channel 32 of the pump housing 12 (shown in FIGS. 10 and 11). Accordingly, an outer edge 114 of the pump cover 26 is also positioned within the retaining channel 32 and the pre-load spring 120 biases the pump cover 26 toward the pump body 78 and away from the retaining ring 118 secured within the locking recess 122. Through this configuration, the alignment features 90 of the pump housing 12 serve to rotationally align the pump body 78 and the pump cover 26. Simultaneously, the pre-load spring 120 serves to axially position the pump cover 26, the pump body 78 and the rotor 18 within the pump housing 12, while also providing a tolerance-absorbing space and expansion and contraction-absorbing space within the fluid pump 10.

Through this configuration of the pre-load spring 120 and the alignment features 90 of the pump housing 12, the components of the fluid pump 10 can be rotationally and axially aligned within the pump housing 12 while also providing for a limited amount of movement within the fluid pump 10 that can absorb thermal expansion and contraction movements and also various manufacturing tolerances of the manufactured components.

According to various aspects of the device, an outer surface 150 of the pump housing 12 can include sealing grooves 152 that can retain one or more O-rings 154 that can be used to seal an outer surface 150 of the pump housing 12 with respect to the fluid-handling assembly 14 within which the fluid pump 10 is installed.

According to various aspects of the device, the fluid pump 10 can include various configurations where the fluid inlet 162 and fluid outlet 164 can be positioned on various portions of the pump housing 12 and/or the pump cover 26. Accordingly, the fluid inlet 162 and fluid outlet 164 can each be positioned within the pump cover 26. Alternatively, the fluid inlet 162 can be installed within a sidewall 160 of the pump housing 12 and the fluid outlet 164 can be installed within the pump cover 26, or vice versa. Accordingly, the fluid pump 10 can be manufactured to be installed within a wide range of fluid-handling assemblies and a wide range of configurations of fluid-handling assemblies. These fluid-handling assemblies can include, but are not limited to, transmissions, fluid delivery mechanisms, and other similar fluid-handling assemblies.

It is to be understood that variations and modifications can be made on the aforementioned structure without departing from the concepts of the present invention, and further it is to be understood that such concepts are intended to be covered by the following claims unless these claims by their language expressly state otherwise.

What is claimed is:

1. A fluid pump comprising:

a stator;

a rotor rotationally operable with respect to the stator;

a drive shaft that extends from the rotor to a pump assembly that delivers a fluid from an inlet to an outlet;

a pump housing that includes an interior cavity that contains the stator, the rotor and the pump assembly;

a pump cover that is disposed at an end of the pump housing, wherein the pump cover defines an end of the interior cavity, and wherein the pump cover is rotationally fixed within the pump housing; and a spring assembly that biases the pump cover in an axial direction toward the pump assembly.

2. The fluid pump of claim 1, wherein the pump housing includes an alignment protrusion that receives the pump cover in a single rotational orientation.

3. The fluid pump of claim 1, wherein the pump cover is positioned within a perimeter retaining channel of the pump housing.

4. The fluid pump of claim 3, wherein the pump cover is axially and slidably operable in a direction parallel with a rotational axis of the rotor and within the perimeter retaining channel to absorb material expansion forces.

5. The fluid pump of claim 3, wherein the spring assembly includes a pre-load spring having a plurality of resilient undulations.

6. The fluid pump of claim 3, wherein the spring assembly is retained in the perimeter retaining channel and is positioned between the pump cover and a retaining ring.

7. The fluid pump of claim 6, wherein the retaining ring, the spring assembly and the pump cover are secured to the pump housing within the perimeter retaining channel and without the use of fasteners.

8. The fluid pump of claim 1, wherein the pump cover includes at least one of the inlet and the outlet.

9. A fluid pump comprising:

a pump housing having an interior cavity;

a pump element positioned within the interior cavity and that delivers a fluid from an inlet to an outlet;

a pump cover that defines an end of the interior cavity, wherein the pump cover and the pump element are rotationally fixed within the pump housing; and a spring assembly that axially biases the pump cover toward the pump element, wherein the spring assembly, the pump cover and the pump element are retained within a perimeter retaining channel of the pump housing without the use of fasteners, wherein a retaining ring secures the spring assembly and the pump cover within the perimeter retaining channel, and wherein the spring assembly is retained in the perimeter retaining channel and is positioned between the pump cover and the retaining ring.

10. The fluid pump of claim 9, wherein the pump element includes a generated rotor.

11. The fluid pump of claim 9, wherein the pump housing includes an alignment protrusion that receives the pump cover and a pump body of the pump element in a single rotational orientation.

12. The fluid pump of claim 11, wherein the pump cover is axially and slidably operable in a direction parallel with a rotational axis of a generated rotor of the pump element and within the perimeter retaining channel to absorb material expansion forces.

13. The fluid pump of claim 9, wherein the spring assembly includes a pre-load spring having a plurality of resilient undulations.

14. The fluid pump of claim 9, wherein the pump cover includes at least one of the inlet and the outlet.

15. A fluid pump comprising:

a pump housing having an interior cavity;

a generated rotor positioned within the interior cavity and that delivers a fluid from an inlet to an outlet;

a pump cover that defines an end of the interior cavity, wherein the pump housing includes an alignment protrusion that receives the pump cover in a single rotational orientation;

a pre-load ring-shaped spring that axially biases the pump cover toward the generated rotor; and a retaining ring that is rotationally and axially fixed relative to the pump housing, wherein the retaining ring, the pre-load ring-shaped spring and the pump cover are positioned within a perimeter retaining channel of the pump housing without the use of fasteners.

16. The fluid pump of claim 15, wherein the pump cover is axially and slidably operable in a direction parallel with a rotational axis of the generated rotor and within the perimeter retaining channel to absorb material expansion forces.

* * * * *